US010258144B2

(12) United States Patent
Garza

(10) Patent No.: US 10,258,144 B2
(45) Date of Patent: Apr. 16, 2019

(54) PORTABLE PICNIC TABLE

(71) Applicant: Eduardo Garza, Corpus Christi, TX (US)

(72) Inventor: Eduardo Garza, Corpus Christi, TX (US)

( * ) Notice: Subject to any disclaimer, the term of this patent is extended or adjusted under 35 U.S.C. 154(b) by 107 days.

(21) Appl. No.: 14/546,077

(22) Filed: Nov. 18, 2014

(65) Prior Publication Data

US 2016/0135585 A1 May 19, 2016

(51) Int. Cl.
*A47B 3/14* (2006.01)
*A47B 37/04* (2006.01)

(52) U.S. Cl.
CPC ..... *A47B 3/14* (2013.01); *A47B 37/04* (2013.01)

(58) Field of Classification Search
None
See application file for complete search history.

(56) References Cited

U.S. PATENT DOCUMENTS 1,736,531 A * 11/1929 Hodinka ..... A47B 3/14 297/159.1
2,548,682 A * 4/1951 Price ..... A47B 3/14 297/158.4
2,558,465 A * 6/1951 Seymour ..... A47B 3/14 108/100
2,613,728 A * 10/1952 Loibl, Sr ..... A47B 3/14 297/139
2,647,562 A * 8/1953 Hoffar ..... A47B 3/14 108/35
2,690,210 A * 9/1954 Holick ..... A47B 3/14 297/158.4
3,574,393 A * 4/1971 Hughes ..... A47B 3/14 108/35
4,615,559 A * 10/1986 Blondeau ..... A47B 3/14 297/124
5,411,314 A * 5/1995 Wallace ..... A47B 3/14 108/131
5,683,135 A * 11/1997 Williams ..... A47B 3/14 108/118
6,042,179 A * 3/2000 Wallace, III ..... A47B 3/14 108/132
6,099,074 A * 8/2000 Wallace, III ..... A47B 3/14 108/132

(Continued)

FOREIGN PATENT DOCUMENTS

DE 102004040283 A1 * 3/2005 ..... A47B 3/14

*Primary Examiner* — David E Allred
(74) *Attorney, Agent, or Firm* — The Law Office of Jerry D. Haynes

(57) ABSTRACT

A portable picnic table which transitions between erect and folded positions. The portable picnic table comprises a table with a table top; a set of folding legs attached beneath the table top on a set of hinges; and a lever coupled to the table top and the set of folding legs to activate folding the legs. The table further includes a pair of benches coupled to the table with a pair of support beams, where each bench includes a seat mounted on a telescopic post, where the telescopic post moves the seat towards and away from the support beam; a set of bench legs extending from the seat, where each bench leg is attached on a hinge to the seat to allow the bench leg to fold; and a lever beneath the seat, where the lever adjust movement of the bench within the support beam.

12 Claims, 1 Drawing Sheet

(56) References Cited

U.S. PATENT DOCUMENTS

| | | | | |
|---|---|---|---|---|
| 7,922,245 | B1 * | 4/2011 | Sawhney | A47B 3/14<br>297/158.4 |
| 2005/0006931 | A1 * | 1/2005 | Meskill | A47B 3/0912<br>297/158.4 |
| 2006/0238003 | A1 * | 10/2006 | Larsen | A47B 3/06<br>297/135 |
| 2008/0238158 | A1 * | 10/2008 | Jiu | A47B 3/14<br>297/158.4 |

* cited by examiner

PORTABLE PICNIC TABLE

BACKGROUND OF THE INVENTION

Field of the Invention

The present invention relates to a picnic table that is adjustable and folds upon itself for quick and easy storage and transport.

Description of Related Art

Spring and summer are ideals times of year for outdoor activities especially sports, fairs and picnics. Many parks and amusement centers provide picnic tables that are setup year round to allow for continuous access for families and friends to gather and share snacks and meals. Often at home, picnic tables are used periodically when the family wishes to host a meal outdoors. Because most picnic tables are large, heavy and awkward to move, a family may leave the table outside for the entire spring and summer, and then move it into a storage shed or garage during the cold months. If the picnic table is left out for the season, a large area of the yard is consumed with the table thereby preventing use of that area while the table is out.

As an alternative, some families may opt to set up portable furniture to use temporarily during the short summer months. These pieces are commonly made from plastic or aluminum for easy transport and storage. But since they are made from such a lightweight material, they are often flimsy and unstable. Many times the plastic chairs will crack or break after a few uses, thereby requiring repeated purchases. Also, the aluminum tables are not sturdy enough to support settings for an entire meal, thus limiting their practical use as an eating table.

Therefore, it would be beneficial in the art to provide outdoor dining furniture that is portable for use whenever and wherever needed by a user. It would also be desirable in the art to provide outdoor dining furniture that is portable, sturdy, lightweight and functional for repeated use.

SUMMARY OF THE INVENTION

In view of the foregoing disadvantages inherent in the prior art, the general purpose of the present invention is to provide a portable picnic table which transitions between erect and folded positions, configured to include all of the advantages of the prior art, and to overcome the drawbacks inherent therein.

Accordingly, an object of the present invention is to provide a portable picnic table that includes a foldable table coupled to a pair of foldable benches.

Another object of the present invention is to provide a portable picnic table with adjustable benches allowing the user to adjust the position of the bench from the table.

Yet another object of the present invention is to provide a portable picnic table with a reinforced table top.

To achieve the above objects, in an aspect of the present invention, a portable picnic table is described comprising a table with a table top; a set of folding legs attached beneath the table top on a set of hinges; and a lever coupled to the table top and the set of folding legs to activate folding the legs. The table further includes a pair of benches coupled to the table with a pair of support beams, where each bench includes a seat mounted on a telescopic post, where the telescopic post moves the seat towards and away from the support beam; a set of bench legs extending from the seat, where each bench leg is attached on a hinge to the seat to allow the bench leg to fold; and a lever beneath the seat, where the lever adjust movement of the bench within the support beam.

These together with other aspects of the present invention, along with the various features of novelty that characterize the present invention, are pointed out with particularity in the claims annexed hereto and form a part of this present invention. For a better understanding of the present invention, its operating advantages, and the specific objects attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DRAWINGS

The present invention relates to a picnic table that is adjustable and folds upon itself for quick and easy storage and transport. The present invention provides a portable picnic table as a versatile and convenient foldable table. The portable picnic table includes a foldable table supported with collapsible benches. The table legs attach to the table top with clips instead of screws thereby allowing folding safely and efficiently. The portable picnic table maintains a customary look of a traditional picnic table while also allowing for effortless portability and storage.

Figure 1:
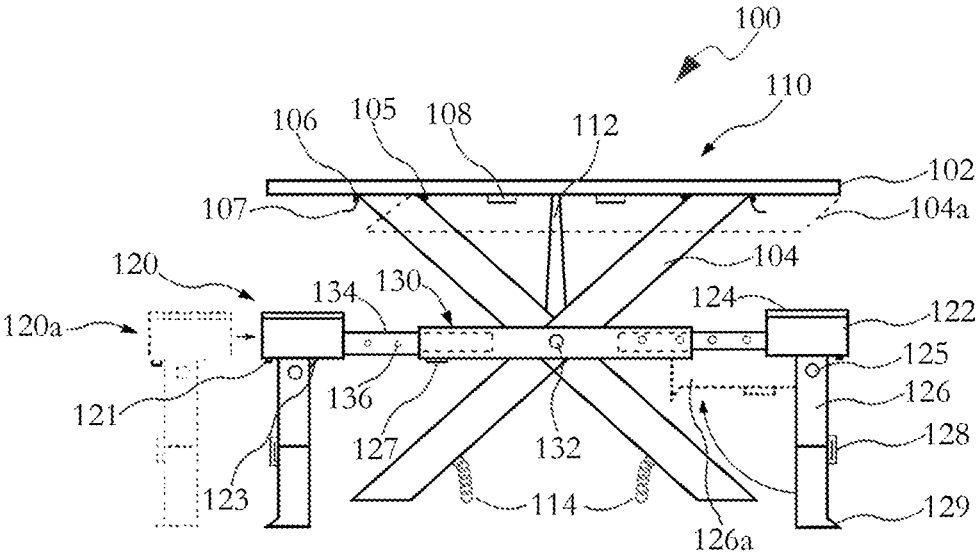
FIG. 1 depicts a perspective view of a portable picnic table in accordance with an exemplary embodiment of the present invention.
Figure 3:
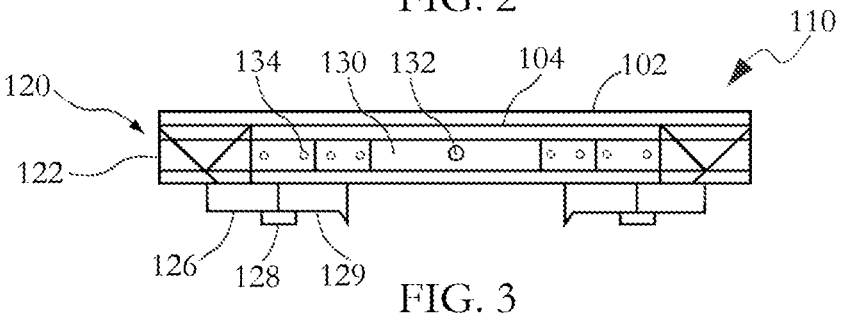
FIG. 3 depicts a side view of a portable picnic table in a folded position in accordance with an exemplary embodiment of the present invention.

Turning now descriptively to the drawings, referring to FIG. 1, a portable picnic table 100 is shown in accordance with an exemplary embodiment of the present invention. The portable picnic table 100 includes a table 110 and a pair of attached benches 120. Both the table 110 and benches 120 are foldable into a folded position as illustrated in FIG. 3, which will be further explained below. FIG. 1 illustrates the table 110 and the benches 120 in their erect positions. The table 110 and bench 120 are made from plastic or aluminum so that the portable picnic table 100 is durable and waterproof while also being lightweight for portability.

The table 110 includes a table top 102 attached and positioned atop a set of legs 104. The first pair of legs 104 are illustrated, but an additional, identical pair are included at the opposite end of the table 110, but are not illustrated for clarity and simplicity. The legs 104 support the table top 102 in the erect position, but they may also fold against the table top 102 as illustrated at 104*a*. The legs 104 may be attached to the table top 102 at a hinge 105. The hinge 105 allows easy movement of the legs 104 from the erect to folded positions. A stopper 106 may be positioned on an opposite portion of the leg 104 from the hinge 105. The stopper 106 braces the leg 104 when in the erect position. When in the folded position 104*a*, the legs 104 may be held in place with a chain 114 and hook 107. The chain 114 may be attached along the leg 104 and then fastened around the hook 107 which is attached beneath the table top 102. A lever 108 may be coupled to the table top 102 and legs 104 which activate folding of the legs 104 for storage. Beneath the table top 102 may be an angled rod 112 that is positioned upright when the table 110 is in the erect position and then may be lowered when the table 110 is in the folded position.

The table 110 is coupled to a pair of benches 120, one bench 120 on each side of the table 110. The benches 120 attach to each other with a pair of support beams 130, one beam at each end of the table 110. The support beam 130 is attached to a swivel fastener 132. The swivel fastener 132 threads through the support beam 130, and is coupled to the legs 104. The same configuration of a support beam attached with a swivel fastener to the second pair of legs is included at the opposite end of the table 110.

The benches 120 may be completely removable as illustrated at 120*a*. The support beam 130 attaches to the benches 120 with a telescopic post 134. The telescopic post 134 includes a set of locking pins 136 that allow the benches 120 to adjust in and out of the support beam 130. A lever 121 is coupled to the bench 120 to securely adjust the telescopic post within the support beam 130, therefore customizing the position of the bench 120 beneath the table 110.

The bench 120 includes a seat 122 with a padded cover 124. The padded cover 124 is waterproof, and provides additional comfort when sitting upon the benches 120. Beneath the seat 122 is a bench leg 126 with a metal foot 129. The bench leg 126 may fold on a hinge 123 against the seat 122 and support beam 130, as illustrated at 126*a*. The folded bench leg 126*a* may be secured against the support beam 130 with a magnet 128 that holds the metal foot 129 in place for storage. The bench leg 126 may be adjustable in height with a knob 125 which extends and retracts the metal foot 129 from the bench leg 126. The metal foot 129 may be textured to ensure that they are non-slip upon any ground surface. To facilitate moving the bench leg 126 on the hinge 123 may be a handle 128.

Figure 2:
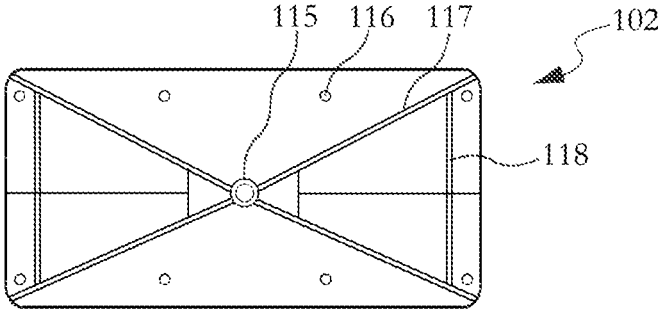
FIG. 2 depicts a top view of a table top in accordance with an exemplary embodiment of the present invention.

Referring now to FIG. 2, a top view of the table top 102 is shown in accordance with an exemplary embodiment of the present invention. The table top 102 includes a centrally positioned umbrella hole 115 to receive an umbrella for shade and rain protection. Around the radial edges of the table top 102 may be a plurality of cup holders 116 to provide convenient resting spots for the users beverages. To provide structural support to the table top 102, a pair of cross bars 117 and a pair of intersecting braces 118 are included beneath the table top 102.

Referring to FIG. 3, a side view of the portable picnic table 100 is shown in a folded position. The portable picnic table 100 layers the table top 102 with the folded legs 104 atop the benches 120. The seats 122 are completely inserted into the support beam 130 and locked in place with the locking pins 136. The bench legs 126 are folded below the seats 122. During storage, the table top 102 may be positioned on the bottom of the folded picnic table 100 to prevent damage to the bench legs 126, metal feet 129 and handles 128. The portable picnic table 100 is especially convenient by allowing the entire structure to be a single unit that folds upon itself for storage and transport. The user is afforded an easy to use eating table that they may take anywhere they desire.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The exemplary embodiment was chosen and described in order to best explain the principles of the invention and its practical application, to thereby enable others skilled in the art to best utilize the invention and various embodiments with various modifications as are suited to the particular use contemplated.

What is claimed is:

1. A portable picnic table, where the portable picnic table transitions between an erect position and a folded position, comprising:

a. a table, where the table includes:
   i. a table top, where the table top includes an umbrella hole;
   ii. a set of folding legs attached beneath the table top on a set of hinges and crossing each other at an intersection in an X-shape in the erect position; and
   iii. a lever coupled to the table top and the set of folding legs, where the lever activates folding the legs; and b. a pair of benches coupled to the table with a pair of support beams, one support beam at each end of the table wherein at least one of the support beams is joined to the set of folding legs at the intersection in the erect position, and, where each bench includes;
   i. a seat mounted on a telescopic post, where the telescopic post moves within the support beam to position the seat towards and away from the support beam, and where the seat includes a padded cover;
   ii. a set of bench legs extending from the seat, where each bench leg is attached on a hinge to the seat to allow the bench leg to fold; and
   iii. a lever beneath the seat, where the lever activates movement of the bench within the support beam.

2. The portable picnic table according to claim 1, where the table top is supported with a pair of cross bars and a pair of braces positioned beneath the table top.

3. The portable picnic table according to claim 1, where the table top includes a plurality of cup holders.

4. The portable picnic table according to claim 1, where each table leg includes a stopper to brace the table leg against the table top.

5. The portable picnic table according to claim 1, where each table leg includes a chain, where the chain fastens to a hook beneath the table top when the table leg is folded.

6. The portable picnic table according to claim 1, where the bench leg includes a handle to facilitate folding and unfolding the bench leg.

7. The portable picnic table according to claim 1, where each bench leg includes a metal foot, where the metal foot is height adjustable from the bench leg.

8. The portable picnic table according to claim 7, where the metal foot is height adjustable from the bench leg with a knob.

9. The portable picnic table according to claim 7, where the support beam includes a magnet to secure the metal foot against the support beam when the bench leg is folded.

10. The portable picnic table according to claim 1, where the benches are coupled to the table legs with a swivel fastener.

11. The portable picnic table according to claim 1, where the telescopic posts are adjustable within the support beam with a plurality of locking pins.

12. The portable picnic table according to claim 1, where the table and the benches are made from aluminum.

* * * * *